US006947522B2

(12) United States Patent
Wilson et al.

(10) Patent No.: US 6,947,522 B2
(45) Date of Patent: Sep. 20, 2005

(54) ROTATING NOTCHED TRANSMISSION X-RAY FOR MULTIPLE FOCAL SPOTS

(75) Inventors: Colin Wilson, Niskayuna, NY (US); Mark Vermilyea, Niskayuna, NY (US); James E. Simpson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 192 days.

(21) Appl. No.: 10/248,153

(22) Filed: Dec. 20, 2002

(65) Prior Publication Data

US 2004/0120463 A1 Jun. 24, 2004

(51) Int. Cl.[7] ..... H01J 35/10; H01J 35/26

(52) U.S. Cl. ..... 378/125; 378/124; 378/134; 378/144

(58) Field of Search ..... 378/124, 125, 378/134, 136, 137, 143, 144

(56) References Cited

U.S. PATENT DOCUMENTS 5,383,232 A * 1/1995 Gabbay et al. ..... 378/124
5,629,970 A * 5/1997 Woodruff et al. ..... 378/143
6,118,853 A 9/2000 Hansen et al.
6,123,052 A * 9/2000 Jahn ..... 123/41.79
6,125,167 A 9/2000 Morgan
6,385,292 B1 5/2002 Dunham et al.
6,480,572 B2 * 11/2002 Harris et al. ..... 378/136
6,487,274 B2 * 11/2002 Bertsche ..... 378/143
6,560,315 B1 * 5/2003 Price et al. ..... 378/144
6,735,283 B2 * 5/2004 Kutschera et al. ..... 378/144
2002/0094064 A1 7/2002 Zhou et al.
2004/0136499 A1 * 7/2004 Holland et al. ..... 378/119

FOREIGN PATENT DOCUMENTS

WO WO 02/31857 4/2002

OTHER PUBLICATIONS

B. D. Cullity. Elements of X–Ray Diffraction, second edition (Reading, MA: Addison–Wesley, 1978), p. 178.*

* cited by examiner

*Primary Examiner*—Allen C. Ho
(74) *Attorney, Agent, or Firm*—Fletcher Yoder

(57) ABSTRACT

An x-ray source with an x-ray source target are provided. The x-ray source includes an electron source. The x-ray source also includes an x-ray transmission window. The x-ray source also includes an x-ray source target located between the electron source and the window, wherein the target is arranged to receive electrons from the electron source to generate x-rays in the x-ray source target, and a rotational mechanism adapted to rotate the x-ray source target. A method of producing x-rays and an x-ray target are also provided.

25 Claims, 5 Drawing Sheets

ROTATING NOTCHED TRANSMISSION X-RAY FOR MULTIPLE FOCAL SPOTS

BACKGROUND OF THE INVENTION

This invention is related generally to an x-ray source, an x-ray source target, and a method of operating the same.

CT (computed tomography) scanning typically uses X-rays to gain two-dimensional (2D) or three-dimensional (3D) information on a scanned object. The X-rays are generated when an electron beam hits a target with a high atomic number, i.e., a target including a high density material. These electrons are typically produced by a hot filament and they are accelerated to the target by a large potential, typically 80 to 120 kV for CT scanning. When the electrons strike the target they interact with the target atoms and generate the x-rays needed for a CT scan.

CT scanning allows a physician to obtain a 2D or planar cross sectional image of a patient. CT scanning can thus reveal anatomical detail for diagnostic purposes. Many such 2D images can be added together to generate a volume in helical or step-and-shoot modes. However, tradeoffs between axial coverage (i.e., the coverage of the patient along the axis of the CT system in a single rotation) and image quality (spatial resolution and noise) limit this coverage cone beam artifacts to about 80 mm because of cone beam artifacts. To provide coverage larger than this with good image quality, x-ray sources with multiple focal spots (i.e., the x-ray source target is impinged by electron beams in multiple spots) must be used.

U.S. Pat. No. 6,125,167 to Picker discloses a multiple spot target design. Picker discloses a conventional reflection x-ray design, wherein the x-rays are reflected from the x-ray generating material, using multiple discs. A multiple spot target design is also disclosed in U.S. Pat. No. 6,118,853 to Hansen et al. The target in this design is stationary and the incident electron beam angle is roughly 90 degrees.

SUMMARY OF THE INVENTION

In accordance with one aspect of the present invention, there is provided an x-ray source. The x-ray source comprises an electron source; an x-ray transmission window; an x-ray source target located between the electron source and the window, wherein the target is arranged to receive electrons from the electron source to generate x-rays in the x-ray source target; and a rotational mechanism adapted to rotate the x-ray source target.

In accordance with another aspect of the present invention, there is provided a method of producing x-rays. The method comprises rotating an x-ray source target; directing electrons from an electron source to the x-ray source target to generate x-rays in the x-ray source target while the x-ray source target is rotating; and transmitting the x-rays through the x-ray source target through an x-ray window.

In accordance with another aspect of the present invention, there is provided an x-ray source target comprising a high density material for generating x-rays; and a support structure supporting the high density material, wherein the support structure is generally shaped as a hollow cylinder with a central axis and has a plurality of notches extending generally radially to the central axis.

DETAILED DESCRIPTION OF THE PREFERRED EMBODIMENTS

Reference will now be made in detail to presently preferred embodiments of the present invention. Wherever possible, the same reference numbers will be used throughout the drawings to refer to the same or like parts.

The present inventors have realized that prior art multiple spot x-ray target designs may be limited in output of x-rays if not designed appropriately. When electrons from an electron beam hit a target and are deflected, over 99% of the electron's energy is dissipated as heat. Thus, the challenge is to design an x-ray target and source such that the source produces sufficient x-rays while not overheating the target surface.

The present inventors have realized that a solution to overheating of the target for a multiple spot target design, and/or maintaining good x-ray parameters, can be accomplished through any one or more of the following three different avenues: (i) developing a source wherein multiple x-ray generating locations can be turned on simultaneously, (ii) continually rotating the target so that new, cooler material is continually being introduced into the electron beam (s), and (iii) angling the surface of the target with respect to the electron beam(s) so that it has a long thermal length yet retaining a small x-ray focal spot dimension.

Figure 1:
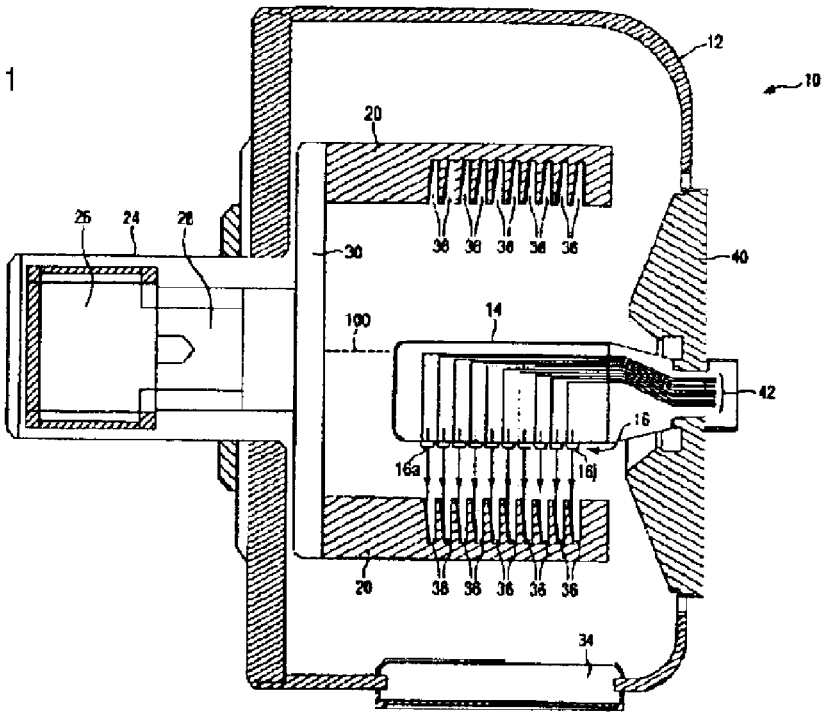
FIG. 1 is side cross sectional view of an x-ray source according to an exemplary embodiment of the invention.

FIG. 1 illustrates a side cross-sectional view of an x-ray source 10 according to one preferred embodiment of the invention. The x-ray source 10 includes a grounded anode frame 12 which encloses a cathode assembly 14. The cathode assembly 14 comprises an electron source 16 which includes a number of individual electron sources 16*a*, 16*b*, 16*c*, 16*d*, 16*e*, 16*f*, 16*g*, 16*h*, 16*i*, 16*j*. The number of individual electron sources is shown as numbering ten for ease of illustration. The number of individual electron sources of the electron source 16 may of course be more or less than ten.

The electron source 16 directs electrons to an x-ray source target 20. The x-ray source 10 includes a motor assembly 24 that acts to rotate the x-ray source target 20. The motor assembly 24 includes a motor 26 that drives and rotates a drive shaft 28. The drive shaft 28 in turn is attached to, and drives, a plate 30. The x-ray source target 20 is coupled to plate 30 such that when the motor is driven, the x-ray source target 20 can be rotated about the cathode assembly 14.

The x-ray source 10 also includes an x-ray transmission window 34. The x-ray transmission window may comprise any x-ray transmissive material, such as, for example, beryllium or aluminum.

The x-ray source target 20 includes a plurality of notches 36. The target 20 is positioned such that the individual electron sources of the electron source 16 each provide an individual electron beam that is directed into a respective one of the notches 36. X-rays are generated in the x-ray source target 20 and these x-rays are transmitted through the region of the target 20 near where the electrons impinge and then onto and out of the x-ray window 34. The target 20 is thus arranged as a target with the electron source 16 on one side of the region of the target 20 where the electrons impinge, and the x-ray window 34 arranged on the other side.

The x-ray source 10 also includes an insulator 40 that surrounds and supports the cathode assembly 14 and insulates the cathode assembly 14 from the grounded anode frame 12. The insulator 40 in turn is supported by the grounded anode frame 12.

The cathode assembly 14 includes a number of control connections 42 that provide control for respective of the individual electron sources 16*a*, 16*b*, 16*c*, 16*d*, 16*e*, 16*f*, 16*g*, 16*h*, 16*i*, 16*j* (see FIG. 2) through electronics (not shown). The individual electron sources 16*a*, 16*b*, 16*c*, 16*d*, 16*e*, 16*f*, 16*g*, 16*h*, 16*i*, 16*j* may be electron emitters, such as for example, thermionic heated tungsten filaments or field emission sources.

Figure 2:
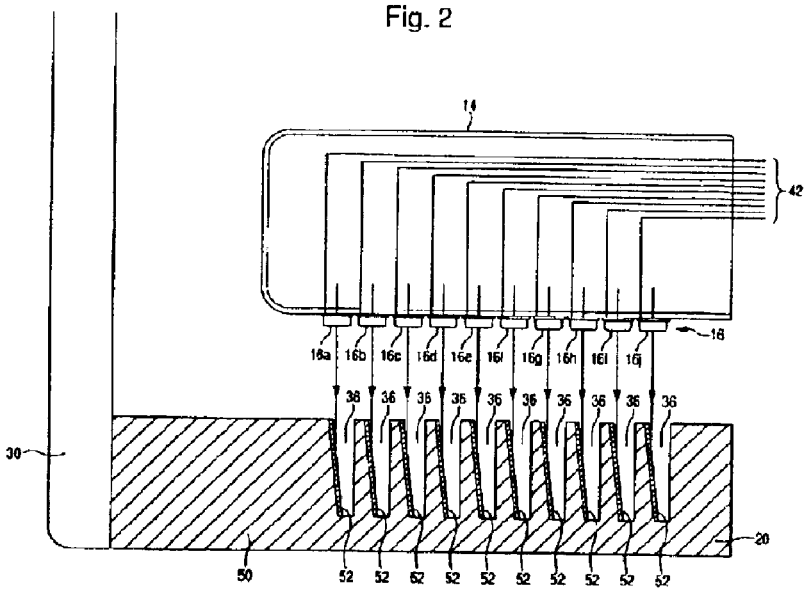
FIG. 2 is an enlarged view of a portion of the x-ray source of FIG. 1.

FIG. 2 is an enlarged view of a portion of the x-ray source showing the cathode assembly 14, x-ray source target 20 and plate 30. The x-ray source target 20 preferably comprises a support structure 50 and a high density material film 52. The support structure 50 or a tungsten film acts to support the high density material film 52, such as a tungsten film, but need not be of a high density material. It is preferable that the support structure 50 comprise a material that is not a high density material, such as graphite for example, so that x-rays are generated substantially only in the high density material film 52. The x-rays generated in the high density material 52 may pass through the support structure 50 and onto the x-ray window 34 (shown in FIG. 1). Preferably films 52 are located only in notches 36. Alternatively, the support structure 50 may be made of a high density material and high density material films may be eliminated. The high density material 52 may be, for example, tungsten or a tungsten alloy, molybdenum, tantalum or rhenium.

The length of the electron source 16, and also the length of the region of the target 20 containing the notches 36, will depend upon the particular application. A longer length will provide an x-ray source that provides x-rays over a greater axial length without cone beam CT artifacts, and thus a greater axial length of an object may imaged using this extended x-ray source. The length of object which can be imaged without significant cone beam CT artifacts from a single-spot x-ray source in the axial scanning mode is limited to about 40 mm.

FIGS. 1 and 2 are side cross sectional views of the x-ray source 10 and a portion of the source 10, respectively. Thus, the x-ray source target 20 is also shown in side cross sectional view. The x-ray source target 20 is preferably arranged to rotate such that the electrons from the electron source 16 continually impinge in the notches 26. The target is preferably shaped as a hollow cylinder which rotates about its rotational axis. The rotational axis is substantially the same as the central axis 100 of the cylinder. The notches 36 may extend generally radially to this central axis 100, on the interior surface of cylinder 20. The cathode assembly 14 including the electron source 16 is positioned inside the cylinder. Other configurations can be used if desired. For example, target 20 may comprise a flat rotating disk located above the window 34 with a line of electron beams impinging on its top surface.

Figure 5:
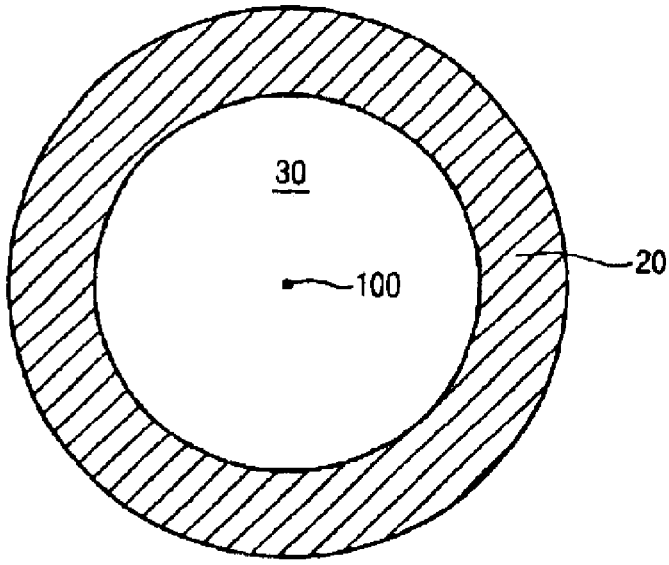
FIG. 5 is a front view of the x-ray source target and plate of the source of the embodiment of FIG. 1.

FIG. 5 is a front view of a portion of the source 10 of FIG. 1 illustrating the x-ray source target 20 and plate 30. The central axis 100 of the x-ray source target 20 points out of the page in FIG. 5.

The rotation of the x-ray source target 20 prevents the region of the target 20 which is receiving the electrons from overheating, because the region of the target 20 receiving the electrons is continually changing. The rotational speed of the x-ray source target 20 will depend upon the particular application. In applications where the rate of electrons impinging upon the target 20 is lower, the rotational speed of the target 20 may also be lowered without risk of overheating the target 20. An exemplary speed range is 3,000 to 10,000 rpm.

Figure 3:
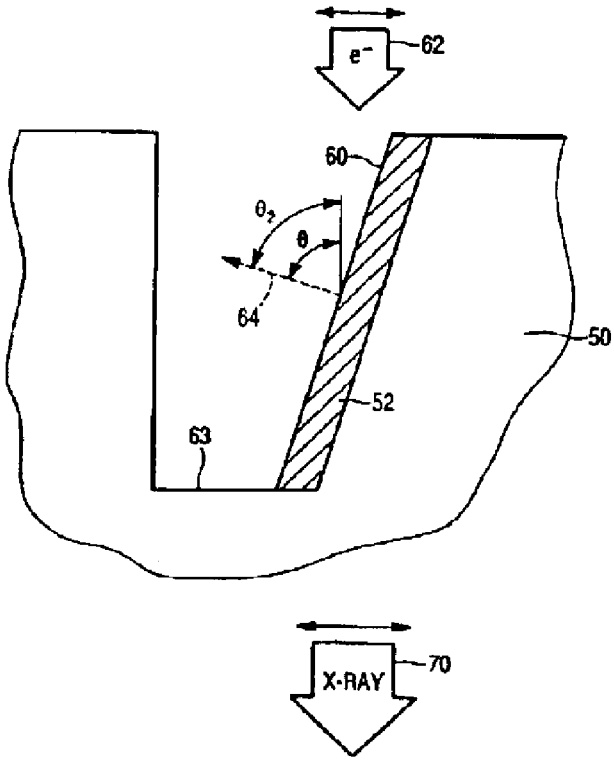
FIG. 3 is a side view of a notch in an x-ray source target according to an embodiment of the invention.

FIG. 3 is a side view of a notch 36 of the plurality of notches 36 according to an embodiment of the invention. In this embodiment the notch 36 includes a side surface 60. The high density material film 52 is preferably located on the side surface 60 but not the bottom 63 of notch 36. However, film 52 may cover every surface of notch 36. The individual electron beam 62 from one of the individual electron sources (see FIGS. 1 or 2), impinges upon the side surface 60. Preferably the electron beam 62 impinges only upon the side surface 60, and not substantially upon a bottom 63 of the notch. Preferably the electron beam 62 is directed at an angle $\theta$ with respect to a normal 64 (the normal 64 is a line that is perpendicular to the side surface 60) in a range of between 80 and 90 degrees. A radial line from the side surface 60 to the central axis 100 (See FIG. 1) makes an angle $\theta_2$ with respect to the normal 64 which is the same as the angle $\theta$.

Because the angle $\theta$ is relatively large, i.e. somewhere near 90°, the electron beam 62 impinges over a substantial portion of the side surface 60, and the electron beam focal spot size, i.e., the area of the side surface 60 upon which the electron beam is impinged, is relatively large. This increase in the electron beam focal spot size reduces the temperature locally at the side surface 60 because the electrons scattered by the high density material film 52 will tend to be absorbed over a wider spread out area by the support 50. Thus, the heat will also be spread out over a larger volume of the target 20.

FIG. 3 also illustrates the size of the x-ray beam 70 emerging from the support 50. While the electron beam focal spot size is increased by increasing the angle between the direction of the electron beam 62 and the normal 64, the x-ray beam 70 spot size, i.e., the cross-sectional area of the x-ray beam, is not substantially increased. This embodiment provides good heat spreading properties, thus beneficially lowering temperature of the region of the high density material upon which the electron beam is impinging, while at the same time the spot size of the x-ray beam is not substantially increased.

FIGS. 1–3 illustrate an x-ray source according to a transmission design, where the x-rays produced in the high density material film are substantially transmitted through the high density material 52 to the x-ray transmission window. In this case the thickness of the high density material 52 may be less than about 20 $\mu$m, and a radial line from the side surface 60 to the central axis 100 (See FIG. 1) makes an angle $\theta_2$ with respect to the normal 64 which is less than 90°. The high density material 52 in this embodiment should be thin enough not to substantially absorb the x-rays generated so that they may be transmitted therethrough.

Figure 4:
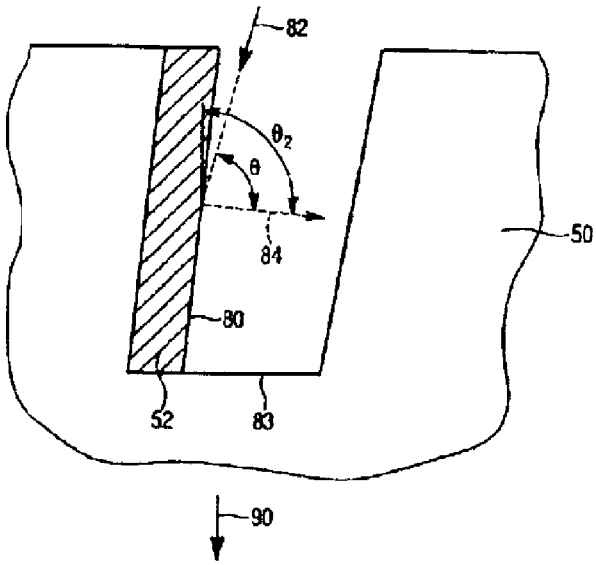
FIG. 4 is a side view of a notch in an x-ray source target according to another embodiment of the invention.

FIG. 4 illustrates another embodiment where the x-rays produced in the high density material film are substantially reflected from the high density material, and not substantially transmitted through the high density material to the x-ray transmission window. In this embodiment the notch has a side surface 80. The high density material film 52 is preferably located on the side surface 80 but not the bottom 83 of notch 36. The individual electron beam 82 from an individual electron sources, impinges upon the side surface 80. In this embodiment the electron beam 82 from the individual electron source is oriented at a non-normal angle to the x-ray transmission window. Preferably the electron beam 82 impinges only upon the side surface 80, and not substantially upon a bottom 83 of the notch. Preferably the electron beam 82 is directed at an angle θ with respect to a normal 84 in a range of between 80 and 90 degrees. A radial line from the side surface 80 to the central axis 100 (See FIG. 1) makes an angle $\theta_2$ with respect to the normal 84 which is greater than the angle θ, and is greater than 90°.

In the embodiment of FIG. 4, the x-ray source 10 shown in FIG. 1 is implemented with the individual electron sources are oriented so that they impinge at the angle shown in FIG. 4.

In the embodiment of FIG. 4, the thickness of the high density material 52 may be greater than about 30 μm, and a radial line from the side surface 80 to the central axis 100 (See FIG. 1) makes an angle $\theta_2$ with respect to the normal 84 which is greater than 90°. The high density material 52 in this embodiment should be thick enough to substantially absorb the x-ray beams 90 generated so that are not substantially transmitted therethrough.

The x-ray source and target described above provides a number of advantages when implemented in a CT scanner system. This target allows the CT scanner to provide the quantity of x-rays needed to generate good CT images without melting the target. It also allows for many focal spots to be stacked in a line over a large axial range. This increased axial range allows whole body organs to be scanned for perfusion studies and volumetric CT imaging. However, the x-ray source 10 may be used in suitable applications other than a CT scanner system.

While the invention has been described in detail and with reference to specific embodiments thereof, it will be apparent to one skilled in the art that various changes and modifications can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An x-ray source comprising:

an electron source;

an x-ray transmission window;

an x-ray source target located between the electron source and the x-ray transmission window, the x-ray source target comprising a support structure and a plurality of notches located in the support structure, wherein each of the plurality of notches has an inclined side surface coated with a high density material film and wherein the electron source is adapted to direct an individual electron beam upon the high density material on the side surface of each of the notches to generate x-rays in the x-ray source target; and a rotational mechanism adapted to rotate the x-ray source target.

2. The x-ray source of claim 1, wherein the high density material film comprises tungsten, tungsten alloy, molybdenum, tantalum or rhenium.

3. The x-ray source of claim 1, wherein the support structure comprises graphite.

4. The x-ray source of claim 1, wherein the x-rays are substantially transmitted through the high density material to the x-ray transmission window.

5. The x-ray source of claim 4 wherein the thickness of the high density material film is less than about 20 μm.

6. The x-ray source of claim 1, wherein the x-rays are substantially reflected from the high density material, and not substantially transmitted through the high density material to the x-ray transmission window.

7. The x-ray source of claim 6, wherein the thickness of the high density material film is greater than about 30 μm.

8. The x-ray source of claim 7, wherein the thickness of the high density material film is greater than about 100 μm.

9. The x-ray source of claim 1, wherein the electron source comprises a plurality of electron emitters, each emitter providing a respective one of the individual electron beams.

10. The x-ray source of claim 1, wherein the rotational mechanism comprises a motor.

11. The x-ray source of claim 10, wherein the rotational mechanism further comprises a drive shaft driven by the motor and a plate driven by the drive shaft, wherein the plate is coupled to the x-ray source target for rotating the x-ray source target relative to the electron source.

12. The x-ray source of claim 1, wherein the x-ray source target comprises a hollow cylinder with a central axis substantially coinciding with a rotational axis of the x-ray source target, and the electron source is located inside the cylinder.

13. The x-ray source of claim 12, further comprising a grounded anode frame, the grounded anode frame supporting the x-ray window.

14. The x-ray source of claim 1, wherein the electron source comprises a plurality of electron emitters.

15. The x-ray source of claim 14, further comprising a cathode assembly including a plurality of control lines, each of the control lines connected to a respective one of the plurality of electron emitters.

16. The x-ray source of claim 14, further comprising:

an insulator section surrounding and supporting the cathode assembly.

17. The x-ray source of claim 1, wherein the x-ray source target comprises a cylinder.

18. An x-ray source comprising:

a rotating x-ray source target comprising a plurality of notches; and an electron source configured to direct individual electron beams onto high density films located in each of the notches to generate x-rays in the x-ray source target while the x-ray source target is rotating, wherein the x-rays are transmitted through the x-ray source target to an x-ray window.

19. The x-ray source of claim 18, wherein the electron source comprises a plurality of electron emitters, each emitter providing a respective one of the individual electron beams.

20. The x-ray source of claim 18, wherein the x-ray source target comprises a hollow cylinder with a central axis substantially coinciding with a rotational axis of the x-ray source target, and the electron source is located inside the hollow cylinder.

21. The x-ray source of claim 18, wherein each of the plurality of notches has an inclined side surface coated with a high density material film.

22. The x-ray source of claim 18, wherein the high density material film comprises tungsten, tungsten alloy, molybdenum, tantalum or rhenium.

23. A method of producing x-rays comprising:

rotating an x-ray source target, the x-ray source target comprising a plurality of notches;

directing individual electron beams from an electron source onto high density films located in each of the notches to generate x-rays in the x-ray source target while the x-ray source target is rotating; and transmitting the x-rays through the x-ray source target to an x-ray window.

24. The method of claim 23, wherein each of the plurality of notches has an inclined side surface, the notches are located in a support structure; the high density material film is located on a side surface of each notch, and the individual electron beam in each of the notches is directed upon the high density material on the side surface, such that the x-rays are substantially transmitted through the high density material to the x-ray transmission window.

25. The method of claim 23, wherein each of the plurality of notches has an inclined side surface, the notches are located in a support structure; the high density material film is located on a side surface of each notch, and the individual electron beam in each of the notches is directed upon the high density material on the side surface, such that the x-rays are substantially reflected from the high density material, and not substantially transmitted through the high density material to the x-ray transmission window.

* * * * *